United States Patent [19]

Ringel et al.

[11] Patent Number: 4,594,946

[45] Date of Patent: Jun. 17, 1986

[54] SHAPED CHARGE CHAIN WITH BOOSTER

[75] Inventors: Konrad Ringel, Leinburg; Rainer Vockentanz, Rednitzhembach, both of Fed. Rep. of Germany

[73] Assignee: Diehl GmbH & Co., Nuremberg, Fed. Rep. of Germany

[21] Appl. No.: 726,426

[22] Filed: Apr. 24, 1985

[30] Foreign Application Priority Data

May 4, 1984 [DE] Fed. Rep. of Germany ..... 3416468

[51] Int. Cl.[4] ..... F42B 1/02

[52] U.S. Cl. ..... 102/307; 102/309; 102/476; 102/310

[58] Field of Search ..... 102/306–310, 102/476

[56] References Cited

U.S. PATENT DOCUMENTS

| | | | |
|---|---|---|---|
| 2,935,020 | 5/1960 | Howard et al. | 102/307 |
| 3,013,491 | 12/1961 | Poulter | 102/310 |
| 3,136,249 | 6/1964 | Poulter | 102/309 |
| 3,311,324 | 3/1967 | Holt et al. | 102/307 X |
| 3,561,361 | 2/1971 | Kessenich | 102/309 X |
| 3,736,875 | 6/1973 | Bucklishch | 102/309 |
| 4,253,523 | 3/1981 | Ibsen | 102/310 X |
| 4,342,261 | 8/1982 | Majerus | 102/307 |

*Primary Examiner*—Peter A. Nelson

*Attorney, Agent, or Firm*—Scully, Scott, Murphy & Presser

[57] ABSTRACT

A shaped charge having plane sides surfaces, in which a booster charge is arranged above a main or primary explosive charge, and wherein the booster charge extends from one of the side surfaces to the oppositely located surface. The booster charge is constituted of an explosive whose detonation velocity is higher than that of the explosive material of the main explosive charge. Thus, when the booster charge is detonated from one side surface thereof, then the booster charge has detonated across the entire length which is present between the two side surfaces, prior to the detonation wave within the main explosive charge having traveled across the entire length thereof.

1 Claim, 2 Drawing Figures

SHAPED CHARGE CHAIN WITH BOOSTER

BACKGROUND OF THE INVENTION

1. Field of the Invention

The present invention relates to a shaped charge having plane side surfaces, in which a booster charge is arranged above a main or primary explosive charge, and wherein the booster charge extends from one of the side surfaces to the oppositely located surface.

2. Discussion of the Prior Art

A shaped charge of the above-mentioned type is described in the specification of German Petty Pat. No. 81 18 005. In that instance, when the booster charge is detonated commencing from one side surface thereof, it will then detonate the main charge from that particular side. Consequently, the detonation propagates in the direction towards the oppositely located side surface. This produces an adverse effect over the action of the shaped charge. In order to attain a uniform detonation of the main explosive charge, it is proposed in the disclosure of U.S. Pat. No. 3,561,361 to initiate the detonation in the middle between the two side surfaces.

The detonation which continues through the booster charge and the main explosive charge is especially disadvantageous when a plurality of shaped charges are positioned adjoining each other in a chain of shaped charges, inasmuch as there is then no longer assured the shaped charges which are more remotely located from the detonating locale will in actuality be detonated by means of the booster charge and not by the adjacent main explosive charge.

When detonation wave guide members are embedded in the shaped charge below the booster charge, then these members become ineffective at that location, whereby the detonation will no longer be transmitted across the booster charge, but will propagate within the main explosive charge.

SUMMARY OF THE INVENTION

Accordingly, it is an object of the present invention to provide a shaped charge of the above-mentioned type which is detonated over its entire length by the booster charge.

Inventively, the foregoing object is attained in a shaped charge of the above-mentioned type, in that the booster charge is constituted of an explosive whose detonation velocity is higher than that of the explosive material of the main explosive charge. Thus, when the booster charge is detonated from one side surface thereof, then the booster charge has detonated across the entire length which is present between the two side surfaces, prior to the detonation wave within the main explosive charge having traveled across the entire length thereof. Accordingly, as a consequence, the main explosive charge is detonated across its entire length by the booster charge. Achieved thereby is an extensively uniform detonation development in the main explosive charge. This is particularly advantageous when a detonation wave guide member is inserted within the main explosive charge, inasmuch as the latter will then be effective over the entire length.

The foregiong also provides satisfactory results when employed with chains of shaped charges, since in that case, all main explosive charges of the chain of shaped charges are detonated commencing from the booster charge, and the detonation wave which travels through the main explosive charges in the longitudinal direction is no longer crucial to the detonation of adjacent main explosive charges.

It has been evidenced that already at a slightly higher detonation velocity of the booster charge, the detonation wave which forms therein will overtake the detonation wave in the main explosive charge which also spreads in the longitudinal direction to such an extent, so as to result in the detonation of the main explosive charge by the booster charge. Preferably, the detonation velocity of the booster charge is at least by about 8% higher than that of the main explosive charge.

BRIEF DESCRIPTION OF THE DRAWINGS

Further advantageous features of the inventive shaped charge can be ascertained from the following description of an exemplary embodiment thereof, taken in conjunction with the accompanying drawings; in which.

DETAILED DESCRIPTION

Figure 1:
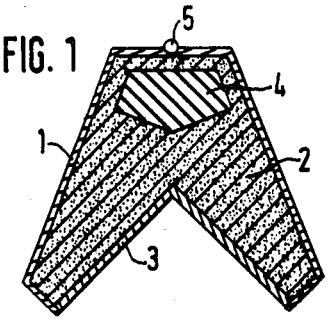
FIG. 1 illustrates a sectional view through the end surface of a shaped charge taken along line I—I in FIG. 2.

A main explosive charge 2 is provided in a shaped charge which is located within a casing or a housing 1. This charge is bordered from below thereof by an insert 3.

Embedded in the main explosive charge 2 is a detonation wave guide member 4. The thickness of the portion of the main explosive charge 2 which is located above the detonation wave guide member 4 is considerably less than the thickness of the portion of the main explosive charge which is located between the detonation wave guide member 4 and the insert 3.

Arranged above the detonation wave guide member 4 is a booster charge 5 which extends across the main explosive charge 2. This booster charge extends between two side surfaces 6 and 7 of the housing 1 located opposite each other. It extends centrally across the detonation wave guide member 4.

The booster charge 5 is constituted of an explosive whose detonation velocity is higher than that of the explosive material of which the main explosive charge 2 is constituted. Utilized as the explosive material for the main explosive charge 2, for example, is an explosive constituted of the components hexogen and TNT, containing about 60% hexogen and 40% TNT. This explosive has a detonation velocity of about 7.8 km/s. Utilized as the explosive material for the booster charge 5, for example, is an explosive constituted of the components octogen and TNT, containing about 70% octogen and 30% TNT. This explosive has a detonation velocity of about 8.45 km/s. Consequently, the detonation velocity of the booster charge 5 is about 8% higher than that of the main explosive charge 2.

When the booster charge 5 is detonated at its one end A, the detonation wave in the booster charges 5 will then travel more rapidly towards the other end B then would be the case if the booster charge 5 were to be constituted of the same explosive as that of the main explosive charge 2. As a result, there are generated within the main explosive charges 2 the detonation wavefronts C which, as shown in phantom in FIG. 2, propagate in the direction of the arrow P. These detonation wavefronts C, which are only slightly inclined with respect to the longitudinal direction of the booster charge, 5 generate within the main explosive charge 2, inasmuch as the main explosive charge or the main explosive charges are detonated from above in all zones thereof. Hereby, the detonation commences in every region of the main explosive charge from above the detonation wave guide member 4 and propagates about the member (refer to FIG. 1).

Figure 2:
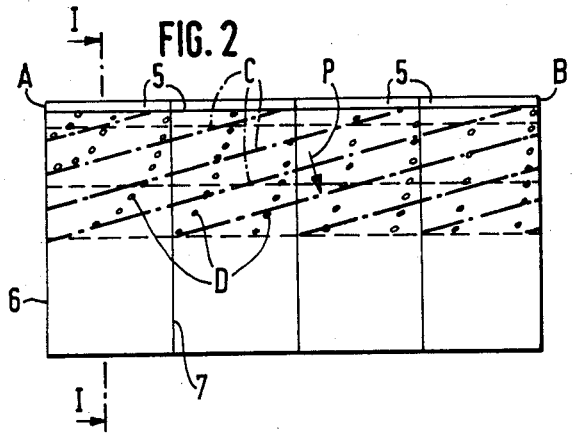
FIG. 2 illustrates a view in the longitudinal direction of a plurality of shaped charges positioned adjacent each other, in which there are indicated the detonation wavefronts.

If the detonation velocity of the booster charge 5 and that of the main explosive charge 2 were to be equal, then there would be produced the detonation wavefronts D shown by the dots in FIG. 2. As a result, the detonation in the main explosive charge 2 or in the main explosive charges would be effected from the side, so that the detonation wave guide member 4 would be completely ineffective.

The utilization of a booster charge with a higher detonation velocity is also advantageous for shaped charges in which there is not provided any detonation wave guide member, inasmuch as the detonation which is implemented from above also brings about an improvement in the effect of the hollow charge-like insert 4.

For a chain of shaped charges it is also possible to arrange the booster charge 5 as a unitary element from above on the chain of shaped charges.

What is claimed is:

1. In a chain of shaped charges consisting of a plurality of charges in which each charge has plane side surfaces, including a booster charge positioned above a main explosive charge, said booster charge extending from one side surface to the oppositely located side surface; the improvement comprising: said booster charge being constituted of an explosive material having a detonation velocity higher than that of the explosive material of the main explosive charge, the detonation velocity of the booster charge being at least by about 8% higher than the detonation velocity of the main explosive charge, and wherein the booster charge extends as a unitary component across said plurality of main explosive charges.

* * * * *